US006647228B2

(12) United States Patent
Nakamura et al.

(10) Patent No.: US 6,647,228 B2
(45) Date of Patent: Nov. 11, 2003

(54) IMAGE FORMING DEVICE

(75) Inventors: Koichi Nakamura, Kyoto (JP); Koichi Yamauchi, Yamatokoriyama (JP); Mitsuyoshi Terada, Osaka (JP); Tadasu Taniguchi, Nara (JP); Hideaki Kadowaki, Kyoto (JP); Yoshikazu Harada, Nara (JP); Hiroshi Tachiki, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/051,117

(22) Filed: Jan. 22, 2002

(65) Prior Publication Data

US 2002/0098009 A1 Jul. 25, 2002

(30) Foreign Application Priority Data

Jan. 23, 2001 (JP) ..... 2001-015116

(51) Int. Cl.[7] ..... G03G 21/00; B65H 5/02

(52) U.S. Cl. ..... 399/124

(58) Field of Search ..... 399/124, 299, 399/223, 231, 306

(56) References Cited

U.S. PATENT DOCUMENTS 4,760,411 A * 7/1988 Ohmura et al. ..... 347/156
4,873,541 A 10/1989 Hirose et al.
5,404,156 A * 4/1995 Yamada et al. ..... 347/115
6,201,944 B1 * 3/2001 Onuki et al. ..... 399/299
6,385,427 B1 * 5/2002 Nakane ..... 399/303

FOREIGN PATENT DOCUMENTS

JP 6-9098 1/1994
JP 11-349159 12/1999

* cited by examiner

*Primary Examiner*—Quana M. Grainger
(74) *Attorney, Agent, or Firm*—Birch, Stewart, Kolasch & Birch, LLP

(57) ABSTRACT

In an image forming device of the present invention, which is a tandem type, electrophotographic image forming device, a first separating/contacting mechanism mechanically lowers/raises the whole of a transfer frame holding the transfer and transport belt unit in association with the opening/closing of a front door, a second separating/contacting mechanism mechanically lowers/raises the right side of the transfer frame in association with the opening/closing of a right side door, and a third separating/contacting mechanism mechanically lowers/raises the left side of the transfer frame in association with the opening/closing of a left side door. Therefore, the handling of a paper jam can be carried out even when power supply is cut off, and the transfer frame can be separated from the photoconductor drums just by opening a door from a plurality of access directions, on a side opened.

7 Claims, 12 Drawing Sheets

IMAGE FORMING DEVICE

FIELD OF THE INVENTION

The present invention relates to an electrophotographic image forming device provided as a copying machine, a printer, and/or a facsimile, etc., so as to transfer a toner image onto a sheet of paper. More particularly, the present invention relates to an image forming device appropriately provided as a tandem type color image forming device using a plurality of kinds of toner.

BACKGROUND OF THE INVENTION

In the tandem type image forming device, toner images are transferred onto a sheet of paper by the following method.

First, a plurality of image bearing elements bearing respective toner images are located in order from one side to the other side of the main unit of the device. Then, a sheet of paper sequentially passes through the respective image bearing elements, with being supported by a transfer and transport bearing element. With this structure, in the tandem type image forming device, a plurality of kinds of the toner images constituting a color image are transferred onto the sheet of paper.

Conventionally, in an image forming device of such a system, the transfer and transport bearing element is lowered and separated from the image bearing elements by opening a front or a side door of the device and then operating a lever, etc., provided in the device. This operation is performed when a sheet of paper is abnormally stopped between the image bearing elements and the transfer and transport bearing element due to transport failure, etc., or at the time of maintenance to replace a process unit which includes an image bearing element and image forming means placed in the surroundings of the image bearing element.

In order to eliminate the foregoing lever operation, for example, (1) the U.S. Pat. No. 4,873,541 (published on Oct. 10, 1989) discloses a method in which the opening of a door of an image forming device is detected, then transfer and transport means is electrically separated from image bearing means, which speeds up the handling of a paper jam.

In the foregoing conventional technique (1), when a paper jam is caused due to some power-down, there are some cases that the transfer and the transport means cannot be separated from the image bearing means although the door of the image forming device is opened, and a jammed sheet of paper cannot be removed.

Besides, in a general image forming device, when a door is opened, power to each part in the image forming device is cut off so as to prevent the operation of each part, which enhances safety. However, in the foregoing electric structure (1), if power is supplied in a condition that a door is opened for the handling of a paper jam, there is a problem that safety is declined.

SUMMARY OF THE INVENTION

It is therefore an object of the present invention to provide an image forming device with high safety, in which a transfer and transport bearing element is separated from an image bearing element in association with the operation of opening a door, even when power supply is cut off.

To achieve the foregoing object, an image forming device of the present invention, which is a tandem type, electrophotographic image forming device in which a plurality of image bearing elements bearing respective toner images are located in order from one side to the other side of the main unit of the device, and a sheet of paper sequentially passes through the respective image bearing elements with being supported by a transfer and transport bearing element, so as to transfer a plurality of kinds of the toner images onto the sheet of paper, is structured so as to include:

a transfer frame holding the transfer and transport bearing element;

a first separating/contacting mechanism mechanically lowering/raising the whole of the transfer frame in association with opening/closing of a front door of the main unit of the device, and separating/contacting the transfer frame from/with the image bearing elements;

a second separating/contacting mechanism mechanically lowering/raising a right side of the transfer frame in association with opening/closing of a right side door of the main unit of the device, and separating/contacting the right side of the transfer frame from/with the image bearing elements; and a third separating/contacting mechanism mechanically lowering/raising a left side of the transfer frame in association with opening/closing of a left side door of the main unit of the device, and separating/contacting the left side of the transfer frame from/with the image bearing elements.

According to the foregoing structure, just by opening a door of the image forming device from a plurality of access directions, the transfer and transport bearing element, which is formed to be long from side to side, can be separated from the image bearing elements in association with the opening of the door, on a side opened. Consequently, to cope with various paper jams related to the transfer and transport bearing element, it becomes possible to handle a paper jam by opening/closing a door of the image forming device from the most appropriate direction. Besides, at the time of replacing a process unit, the replacement can be easily carried out by opening/closing a door which is appropriate for the replacement.

Since the opening/closing operation of the doors is mechanically converted to carry out separating/contacting operation of transfer and transport means, this structure enables the separating/contacting operation to be carried out even when power supply is cut off. Further, by arranging to cut off power supply when a door is opened, this structure can enhance safety.

Besides, in the image forming device of the present invention, the transfer frame holding the transfer and transport bearing element has support axes protruding from its four corners in a front-to-rear direction, and the image forming device is structured so as to further include:

holding plates each of which is swingably displaced about an axis line extending in the front-to-rear direction;

holding arms each of which raises/lowers each of the support axes by being swingably displaced about an axis provided on each of the holding plates;

holding levers each of which is swingably displaced about an axis provided on each of the holding plates, and has a long hole in which an axis provided on each of the holding arms is inserted with a clearance;

holding stays connecting lower parts of a pair of the holding plates provided in front and rear;

wedge-shaped link blocks located at the four corners of the transfer frame and inserted between a base of the main unit and the holding stays;

a link mechanism which extracts/inserts the link blocks in association with the opening/closing of the front door of the main unit of the device; and driving members each of which separates from or contacts an end section of each of the holding levers on a side opposite to a side provided with the long hole, in association with the opening/closing of the respective side doors of the main unit of the device, wherein the holding arms, the holding levers, the holding plates, the holding stays, the link blocks, and the link mechanism constitute the first separating/contacting mechanism, in which the link mechanism extracts/inserts the link blocks between the base of the main unit of the device and the holding stays in association with the opening/closing of the front door of the main unit of the device, lowering/raising the support axes at the four corners of the transfer frame together from the holding stays provided on the right and the left sides, via the holding plates, the holding levers, and the holding arms, and separating/contacting the transfer frame from/with the image bearing elements, and the holding arms, the holding levers, the holding plates, and the driving members constitute the second and the third separating/contacting mechanisms, in which the driving members provided to the respective side doors of the main unit of the device separate from or contact the end sections of the holding levers on the side opposite to the side provided with the long holes, in association with the opening/closing of the respective side doors, lowering/raising the support axes of the transfer frame on the sides of the respective side doors via the holding levers and the holding arms, and separating/contacting the respective sides of the transfer frame from/with the image bearing elements.

According to the foregoing structure, the first through the third separating/contacting mechanisms can be specifically structured.

For a fuller understanding of the nature and advantages of the invention, reference should be made to the ensuing detailed description taken in conjunction with the accompanying drawings.

DESCRIPTION OF THE PREFERRED EMBODIMENTS

Referring to FIGS. 1 through 12, the following description will describe one embodiment of the present invention.

Figure 1:
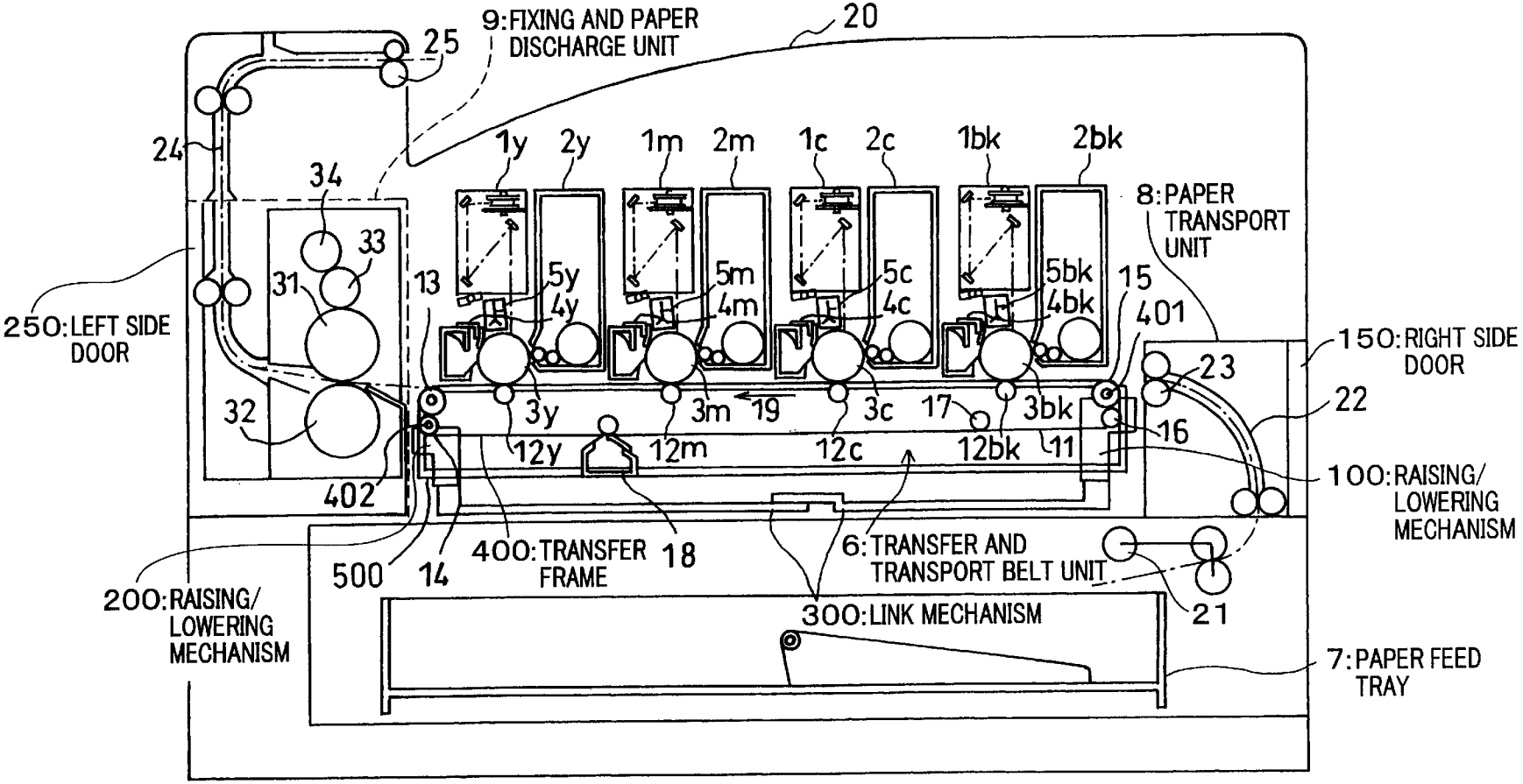
FIG. 1 is a vertical sectional view schematically showing an overall structure of an image forming device in accordance with one embodiment of the present invention.

FIG. 1 is a vertical sectional view schematically showing an overall structure of an image forming device in accordance with one embodiment of the present invention. The image forming device is realized as a so-called printer. That is, the image forming device forms a color image on a predetermined sheet such as a recording sheet of paper and an OPC film, etc., by electrophotography, according to image data transmitted externally. Therefore, the image forming device is broadly structured so as to include optical units 1, developers 2, photoconductor drums (image bearing elements) 3, cleaner units 4, charging units 5, a transfer and transport belt unit (transfer and transport bearing element) 6, a paper feed tray 7, a paper transport unit 8, and a fixing and paper discharge unit 9.

Incidentally, the image data handled by the image forming device corresponds to color images using black (BK), cyan (C), magenta (M), and yellow (Y), respectively. Therefore, the optical units 1, the developers 2, the photoconductor drums 3, the cleaner units 4, and the charging units 5 are structured so as to form four kinds of latent images in respective colors.

Specifically, these units are provided by four for each kind: that is, four optical units 1 are provided as optical units 1*bk,* 1*c,* 1*m,* and 1*y;* four developers 2 are provided as developers 2*bk,* 2*c,* 2*m,* and 2*y;* four photoconductor drums 3 are provided as photoconductor drums 3*bk,* 3*c,* 3*m,* and 3*y;* four cleaner units 4 are provided as cleaner units 4*bk,* 4*c,* 4*m,* and 4*y;* and four charging units 5 are provided as charging units 5*bk,* 5*c,* 5*m,* and 5*y.*

The foregoing units with an affix bk are set to form a black image, and those with affixes c, m, and y are also set to form a cyan, magenta, and yellow image, respectively. Four image stations are placed in tandem from one side to the other side of the main unit of the device. In the following explanation, the affixes bk, c, m, and y will be omitted when describing all the colors.

Each optical unit 1 is realized by a so-called laser scanning unit (LSU) provided with a laser emitting section and a reflection mirror. Specifically, each optical unit 1 emits laser light on the surface of each photoconductor drum 3 uniformly charged by each charging unit 5, so as to form an electrostatic latent image according to image data. The LSU scans laser light emitted from a single light source in the direction of an axis line of the photoconductor drum 3. Incidentally, not only the LSU, but also an LED head in which LED devices are arranged in the direction of the axis line of the photoconductor drum 3 may be used as the optical unit 1.

The developers 2 visualize the electrostatic latent image formed on each photoconductor drum 3 as described above, using toner in black, cyan, magenta, or yellow. The cleaner units 4 remove and collect toner remained on the surfaces of the photoconductor drums 3 after the images are transferred. The charging units 5 charge the surfaces of the photoconductor drums 3 uniformly at a predetermined potential as mentioned above, and a charger-type or a contact-type charging unit is used.

The transfer and transport belt unit 6, located below the photoconductor drums 3, is structured so as to include a transfer belt 11, transfer rollers 12 (12*bk,* 12*c,* 12*m,* 12*y*), a transfer belt driving roller 13, transfer belt following rollers 14 to 16, a transfer belt tension roller 17, and a transfer belt cleaner unit 18. Each of the transfer rollers 12, the transfer belt driving roller 13, the transfer belt following rollers 14 to 16, and the transfer belt tension roller 17 is rotatably supported by a transfer frame 400 located inside of the transfer and transport belt unit 6. These rollers stretch the transfer belt 11, and drive the transfer belt 11 to rotate in the direction shown by an arrow 19.

The transfer belt 11 is contacted with the photoconductor drums 3 by the transfer rollers 12. With this structure, toner images in respective colors formed on the respective photoconductor drums 3 are sequentially transferred with being overlaid on a sheet of paper sucked and fed on the transfer belt 11, forming a color toner image (multiple color toner image). The transfer belt 11 is formed in an endless shape, using such as a film with a thickness of around 100 $\mu$m.

A high voltage (of an opposite polarity (+) when the toner is charged, for example, negative) is applied to the transfer rollers 12, so as to transfer the toner images. Each of the transfer rollers 12 is formed, for example, by coating the surface of a metal roller made of such as stainless steel, having a diameter of 8 to 10 mm, with a conductive elastic material such as EPDM or urethane foam. The conductive elastic material allows the transfer rollers 12 to come into tight contact with a sheet and to be uniformly applied with the high voltage.

The transfer belt cleaner unit 18 is provided to remove and collect toner adhered from the photoconductor drums 3 to the transfer belt 11, so as to prevent the toner from staining the rear side of the sheet.

The paper feed tray 7 is a tray for storing sheets to be used for image forming, and it is provided below the image forming section of the image forming device. The paper discharge tray 20 provided in an upper part of the image forming device is a tray for holding a sheet on which an image is formed.

A sheet in the paper feed tray 7 is picked up by a pick up roller 21 and transported to the transfer and transport belt unit 6 at predetermined timing for image forming, via a paper transport path 22 of the paper transport unit (transport unit) 8 and a resist roller 23. The sheet on which image transfer is completed is transported from the transfer and transport belt unit 6 to the fixing and paper discharge unit 9. Then, after toner is heated and fixed onto the sheet which will be mentioned later, the sheet is discharged onto the paper discharge tray 20, via a paper transport path 24 and a paper discharge roller 25, with being reversed (with a side having a multiple-color toner image facing down).

The fixing and paper discharge unit (fixing unit) 9 is structured so as to include a heat roller 31, a pressure roller 32, and surface lubricant coating rollers 33 and 34. The heat roller 31 and the pressure roller 32 are structured so as to rotate with sandwiching a sheet between them.

The heat roller 31 is controlled by a control section (not shown) so as to be at a predetermined fixing temperature, based on an output value of a temperature detection device (not shown), and it provides a sheet with thermocompression bonding together with the pressure roller 32. With this structure, the heat roller 31 melts, mixes, and welds by pressure a multiple-color toner image transferred onto a sheet, and heats and fixes the image onto the sheet.

It is to be noted in the present invention that an raising/lowering mechanism 100 (a first and a second separating/contacting mechanisms), an raising/lowering mechanism 200 (the first and a third separating/contacting mechanisms), and a link mechanism 300 (the first separating/contacting mechanism) are provided so as to mechanically lower/raise the transfer frame 400 holding the transfer and transport belt unit 6, which is the transfer and transport bearing element. The raising/lowering mechanisms 100 and 200 and the link mechanism 300 lower/raise four corners of the transfer frame 400 in association with the opening/closing of a front door (not shown). These mechanisms realize the first separating/contacting mechanism which separates/contacts the transfer belt 11 from/with the photoconductor drums 3, which are the image bearing elements.

Besides, the raising/lowering mechanism 100 lowers/raises right corners of the transfer frame 400 in association with the sliding out/in of the paper transport unit 8 in accordance with the opening/closing of a right side door 150, realizing the second separating/contacting mechanism which separates/contacts the transfer belt 11 from/with the photoconductor drums 3. Furthermore, the raising/lowering mechanism 200 lowers/raises left corners of the transfer frame 400 in association with the sliding out/in of the fixing and paper discharge unit 9 in accordance with the opening/closing of a left side door 250, realizing the third separating/contacting mechanism which separates/contacts the transfer belt 11 from/with the photoconductor drums 3.

Figure 2:
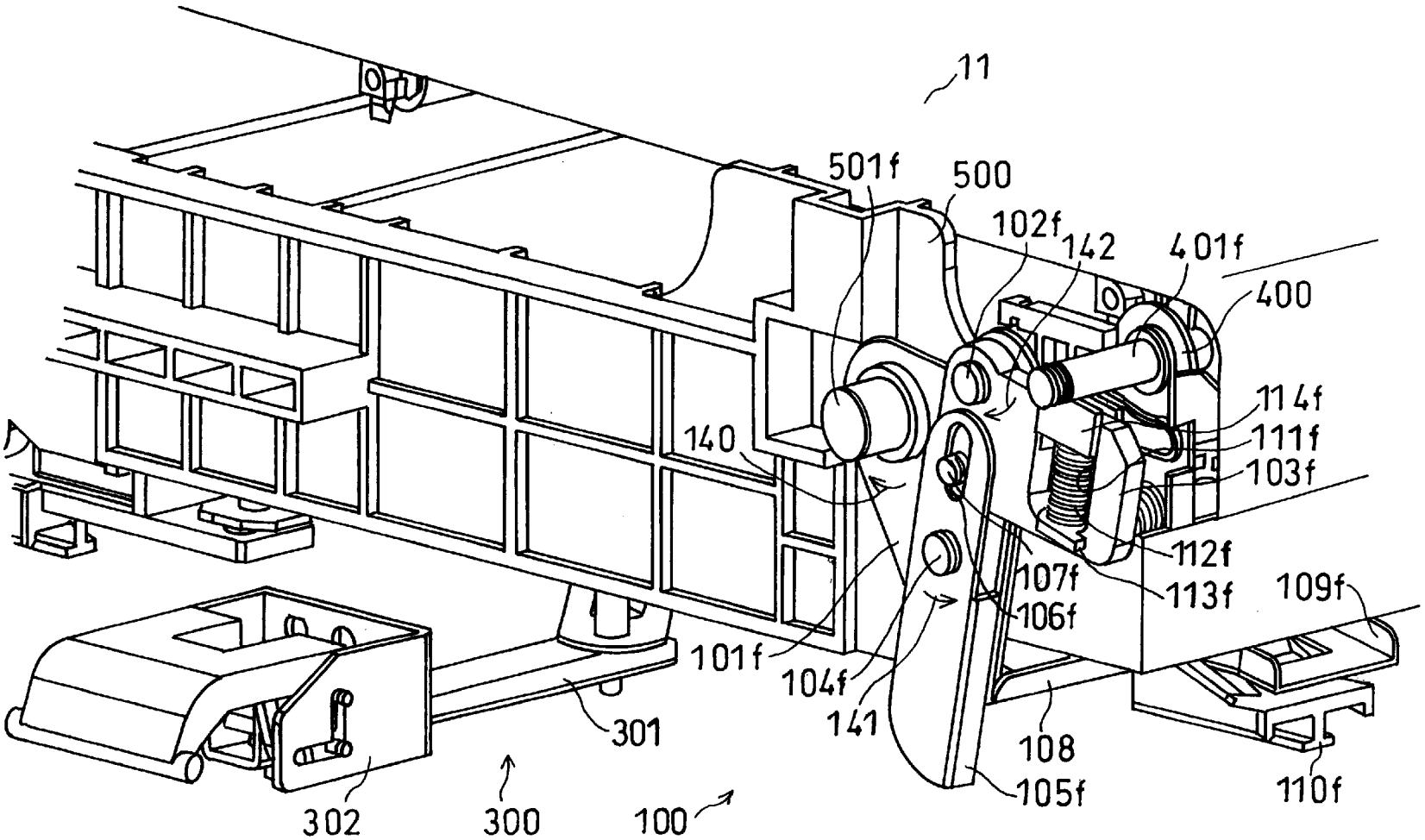
FIG. 2 is a perspective view showing a part in proximity to a raising/lowering mechanism on the right side of the image forming device.
Figure 3:
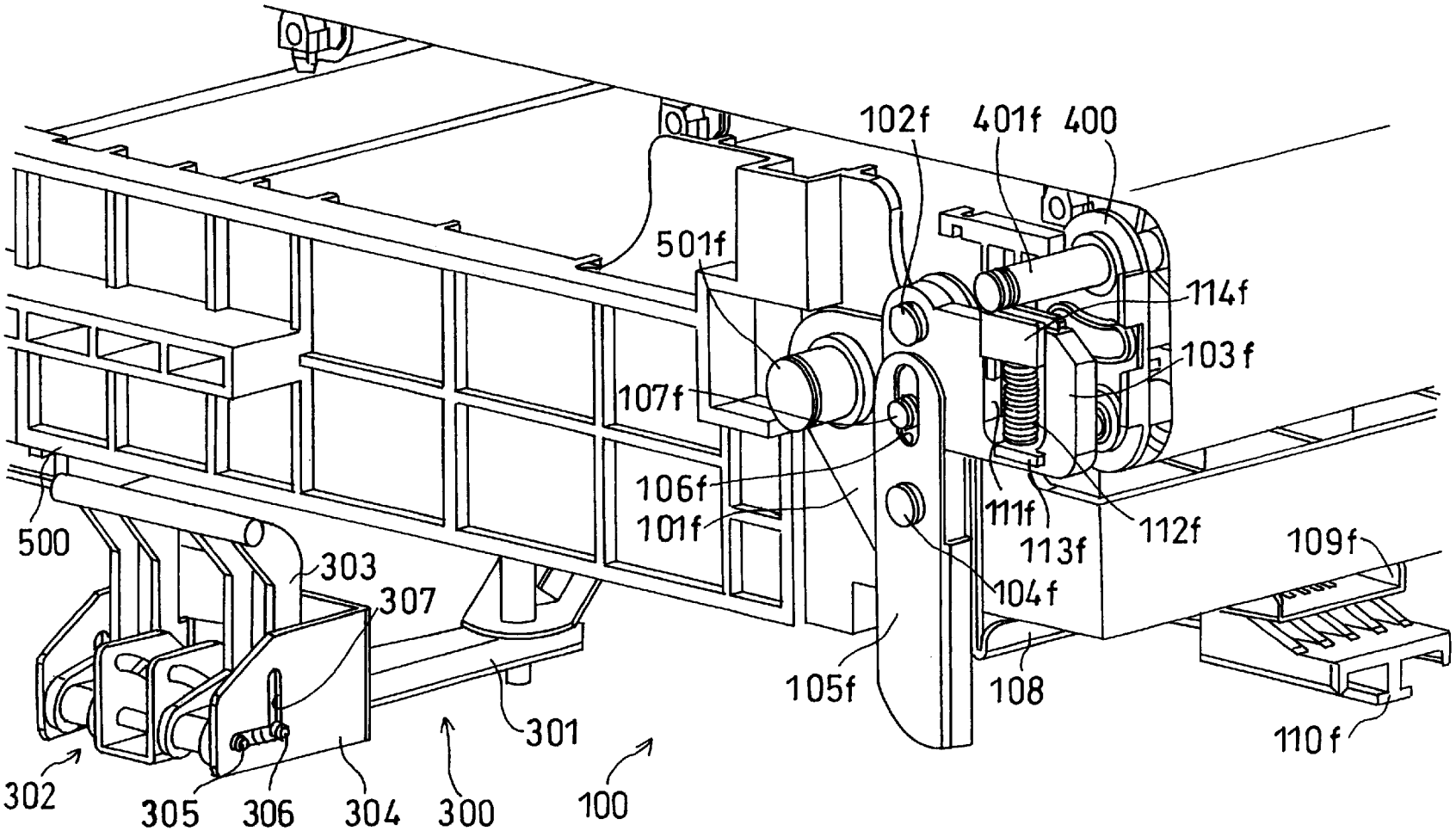
FIG. 3 is a perspective view showing the part in proximity to the raising/lowering mechanism on the right side, which is in a state different from that shown in FIG. 2.
Figure 4:
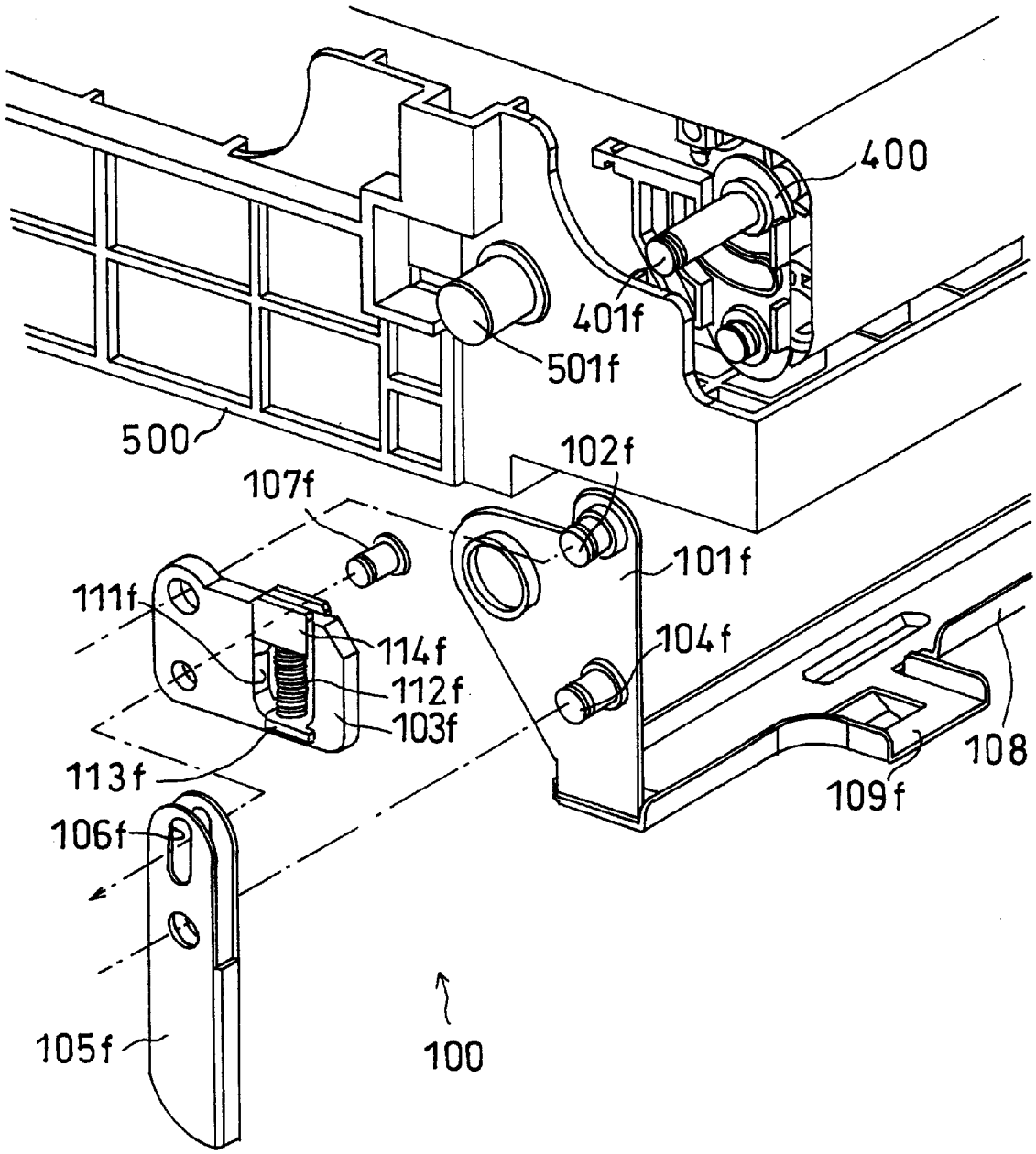
FIG. 4 is an exploded perspective view showing the part in proximity to the raising/lowering mechanism shown in FIGS. 2 and 3.
Figure 5:
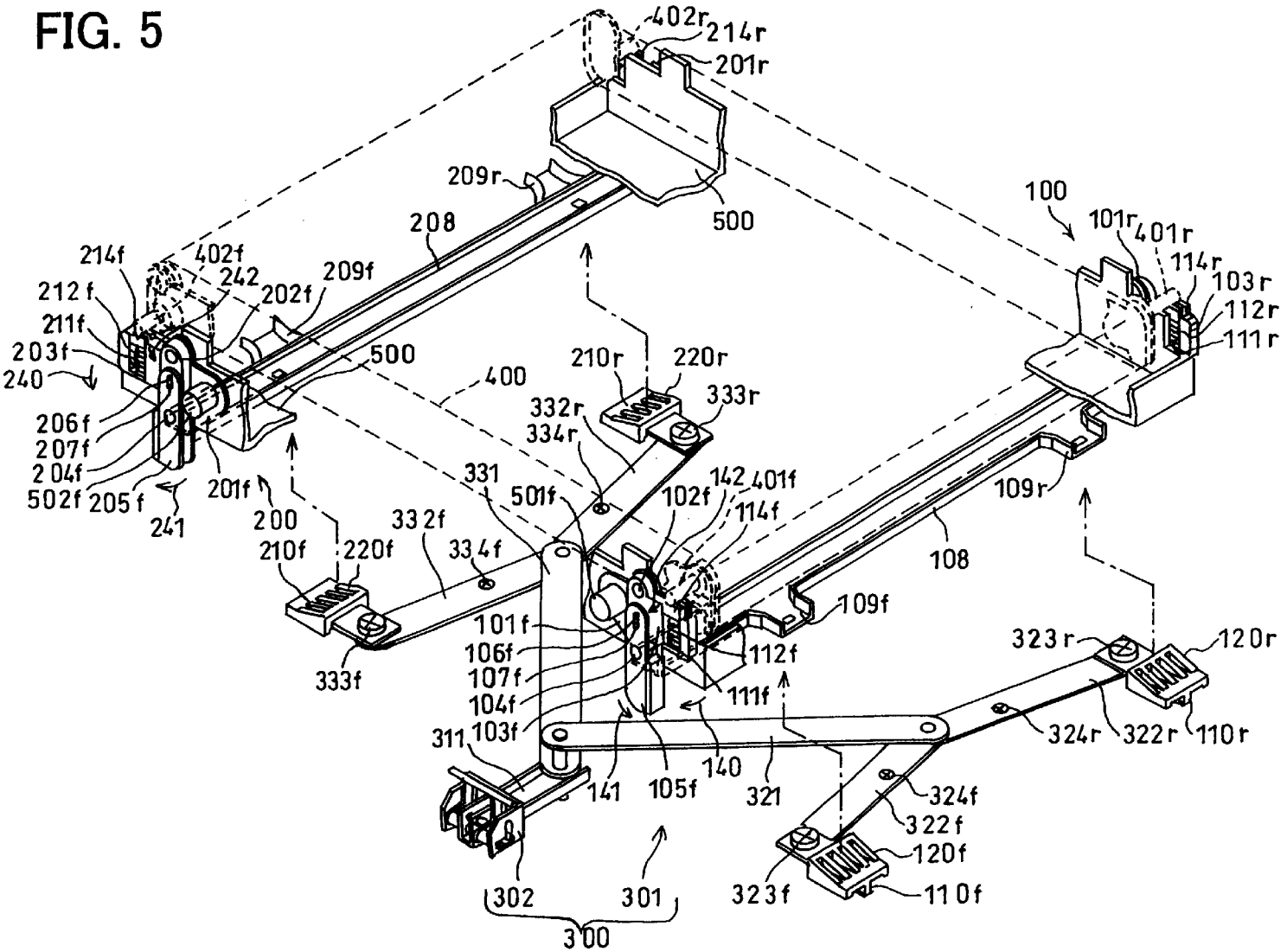
FIG. 5 is a perspective view for explaining a link mechanism in the image forming device.

FIGS. 2 and 3 are perspective views showing a part in proximity to the raising/lowering mechanism 100, FIG. 4 is an exploded perspective view showing the part in proximity to the raising/lowering mechanism 100, and FIG. 5 is a perspective view for explaining the link mechanism 300. Incidentally, the raising/lowering mechanism 200 is the same as the raising/lowering mechanism 100 and is symmetrically structured, so drawings corresponding to FIGS. 2 to 4 will be omitted. The frame structure of the transfer and transport belt unit 6 is a dual structure, having an outer transfer frame 500 and the inner transfer frame 400, and as mentioned above, the rollers 13 to 17 which stretch the transfer belt 11 and drive the transfer belt 11 to rotate, the transfer roller 12, and the transfer belt cleaner unit 18, etc., are supported by the transfer frame 400.

In the transfer frame 500 are provided positioning sections realizing guidance function and positioning function when raising/lowering the transfer frame 400 as will be described later, at two spots each in the front and the rear, at four spots in total, which are supported by the main unit of the device.

The positioning of the part of the transfer and transport belt unit 6 supported by the transfer frame 400 is realized as follows. That is, the foregoing positioning is realized such that the transfer frame 400 is raised by the raising/lowering mechanisms 100 and 200 until it contacts a positioning member (not shown) provided in the main unit of the device, on the basis of the transfer frame 500. The transfer frame 400 has support axes 401*f,* 401*r;* 402*f,* 402*r* protruding from its four corners in a front-to-rear direction, and, as will be described later, it is structured that the transfer and transport belt unit 6 is raised/lowered by supporting the support axes 401*f,* 401*r;* 402*f,* 402*r* from underneath.

Incidentally, when describing a pair of a front and a rear elements in the following explanation, the front element will be indicated with an affix f, the rear element will be indicated with an affix r, and when they are named generically, the affixes will be omitted. In the structure shown in FIGS. 1 through 5, the support axes 401 and 402 become the axes of the following rollers 15 and 14 of the transfer belt 11, respectively, but they may also be separately provided to the transfer frame 400.

On the transfer frame 500 fixed to the main unit of the device are provided support axes (axis lines) 501 and 502 protruding in a front-to-rear direction. To the support axes 501 and 502, holding plates 101 and 201 are attached so as to be swingably displaced, respectively. Besides, support axes (axes standing on the holding plates) 102 and 202 are provided on the holding plates 101 and 201, respectively, and holding arms 103 and 203 are supported by the support axes 102 and 202 so as to be swingably displaced, respectively. That is, the holding plates 101 and 201 are supported so as to be swingably displaced with respect to the transfer frame 500, and the holding arms 103 and 203 are further supported so as to be swingably displaced with respect to the holding plates 101 and 201, respectively, constituting a dual structure.

In a free-end side of the holding arms 103 and 203 are formed storage concaves 111 and 211, in which compression springs 112 and 212 are stored, respectively. The compression springs 112 and 212 are attached to the storage concaves 111 and 211 by washers 113 and 213 at their respective ends on one side, and U-shaped blocks 114 and 214 are attached to their respective ends on the other side, respectively. The concave parts of the U shape of the blocks 114 and 214 engage the frame sections of the holding arms 103 and 203 forming the storage concaves 111 and 211, and the respective ends on the other side of the compression springs 112 and 212 are attached to the bottom parts of the U shape, and the tip parts of the U shape contact the support axes 401 and 402, respectively.

Meanwhile, the holding plates 101 and 201 are provided with support axes (axes standing on the holding plates) 104 and 204, and holding levers 105 and 205 are supported by the support axes 104 and 204, respectively, so as to be swingably displaced. The holding levers 105 and 205 have long holes 106 and 206 at respective ends on one side, in which axes (bosses) 107 and 207 provided on the holding arms 103 and 203 are inserted with a clearance, respectively. Respective ends on the other side of the holding levers 105 and 205 are in contact with driving members provided on the side doors 150 and 250 which will be described later, respectively.

The lower parts of the holding plates 101*f* and 101*r*, and 201*f* and 201*r*, in which a front and a rear holding plates are paired, are connected one another by holding stays 108 and 208, respectively. Facing support plates 109*f*, 109*r*; 209*f*, 209*r* provided in the holding stays 108 and 208 in pairs, respectively, wedge-shaped link blocks 110*f*, 110*r*; 210*f*, 210*r* are inserted between the holding stays 108 and 208 and the base of the main unit. These link blocks 110 and 210 can slide and move on guiding members (not shown) extending in a left-to-right direction of the main unit of the device, and are driven by a link 301 so as to be slid out/in in the left-to-right direction.

The link 301 constitutes the link mechanism 300 together with a conversion mechanism 302. The conversion mechanism 302 is structured so as to include, for example, a link lever 303, two axes 305 and 306 penetrating a link hinge 304, and a L-shaped long hole 307 provided to the link hinge 304. The conversion mechanism 302 converts a rotation displacement of a front door 350 (see FIG. 6) in association with the opening/closing operation of the front door 350, to a linear displacement, and inputs it to the link 301.

The link 301 is structured so as to include an input lever 311 connected to the conversion mechanism 302 at one end; links 321 and 331 whose respective ends on one side are commonly connected to the other end of the input lever 311 and which extend in right and left angularly sideward directions; links 322*f*, 322*r*; 332*f*, 332*r* whose respective ends on one side are commonly connected to respective ends on the other side of the links 321 and 331, respectively; and the link blocks 110*f*, 110*r*; 210*f*, 210*r*. Respective ends on the other side of the links 322*f*, 322*r*; 332*f*, 332*r* are connected to the link blocks 110*f*, 110*r*; 210*f*, 210*r* by stage screws 323*f*, 323*r*; 333*f*, 333*r*, respectively. The virtually central parts of the links 322*f*, 322*r*; 332*f*, 332*r* are swingably supported on the main unit of the device by stage screws 324*f*, 324*r*; 334*f*, 334*r*. The conversion mechanism 302 is provided at a place close to a virtually central part in a width direction of the front door 350. The links 321 and 331, and the links 322*f*, 322*r*; 332*f*, 332*r* are symmetrically structured, respectively.

In the raising/lowering mechanisms 100 and 200 and the link mechanism 300 structured as above, when all the doors 350, 150, and 250 are closed, firstly, since the front door 350 is closed, the link blocks 110 and 210 push up the support plates 109 and 209 of the holding stays 108 and 208, respectively, which will be described later. Then, the holding plates 101 and 201 are rotated about the support axes 501 and 502 in a direction opposite to arrows 140 and 240, respectively, so as to be raised.

Figure 9:
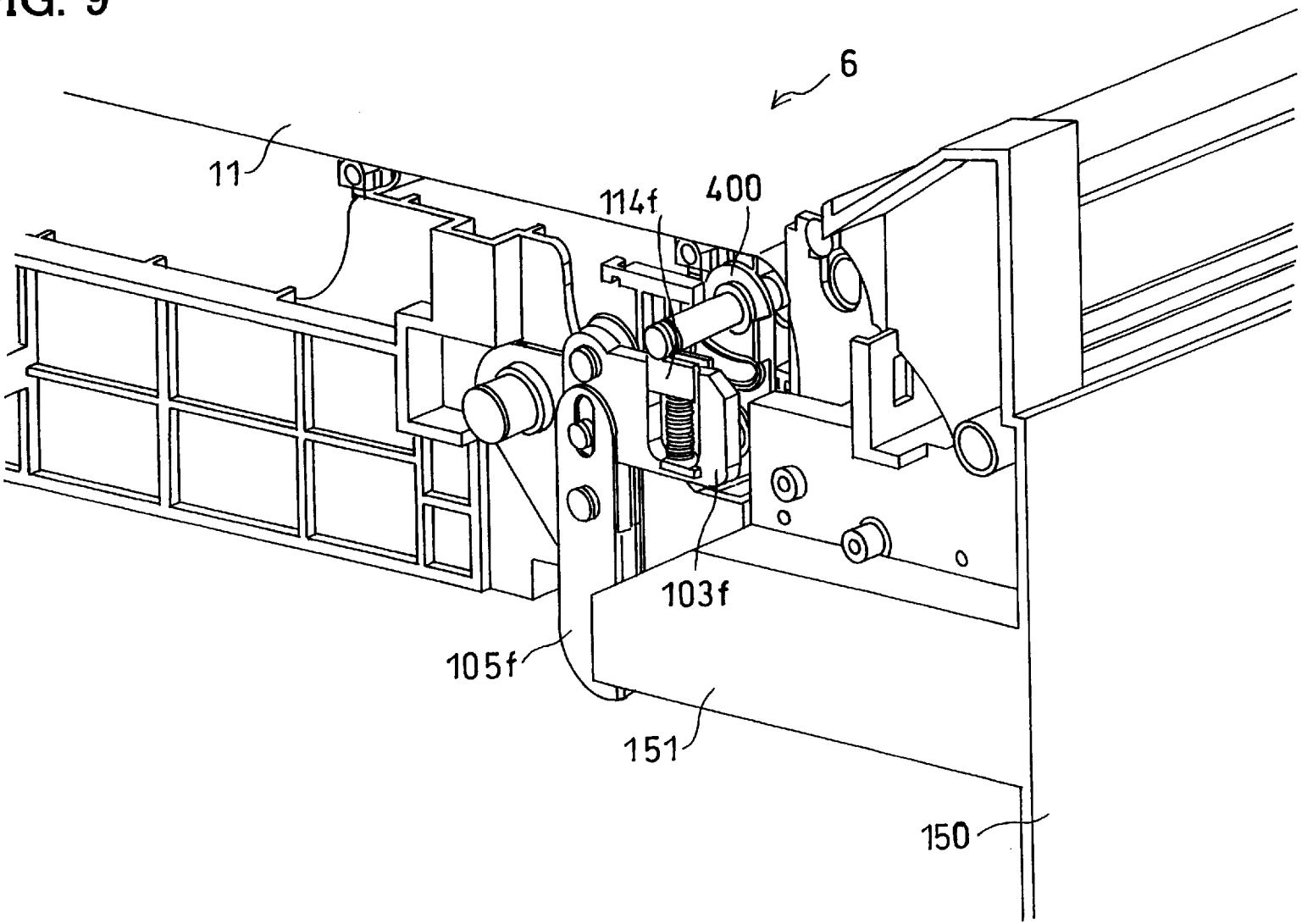
FIG. 9 is a perspective view for explaining a state where the front door and a right side door are closed.

Further, the respective ends on the other side of the holding levers 105 and 205 are pushed in by the driving members respectively provided to the right and the left side doors 150 and 250 (the numeral 151 in FIG. 9 as for a driving member of the right side door 150). Then, the holding arms 103 and 203 are displaced about the support axes 102 and 202 in directions opposite to arrows 142 and 242, and push up the support axes 401 and 402 via the blocks 114 and 214, respectively. In this manner, the transfer belt 11 comes into contact with the photoconductor drums 3, making it possible to perform image forming.

Figure 6:
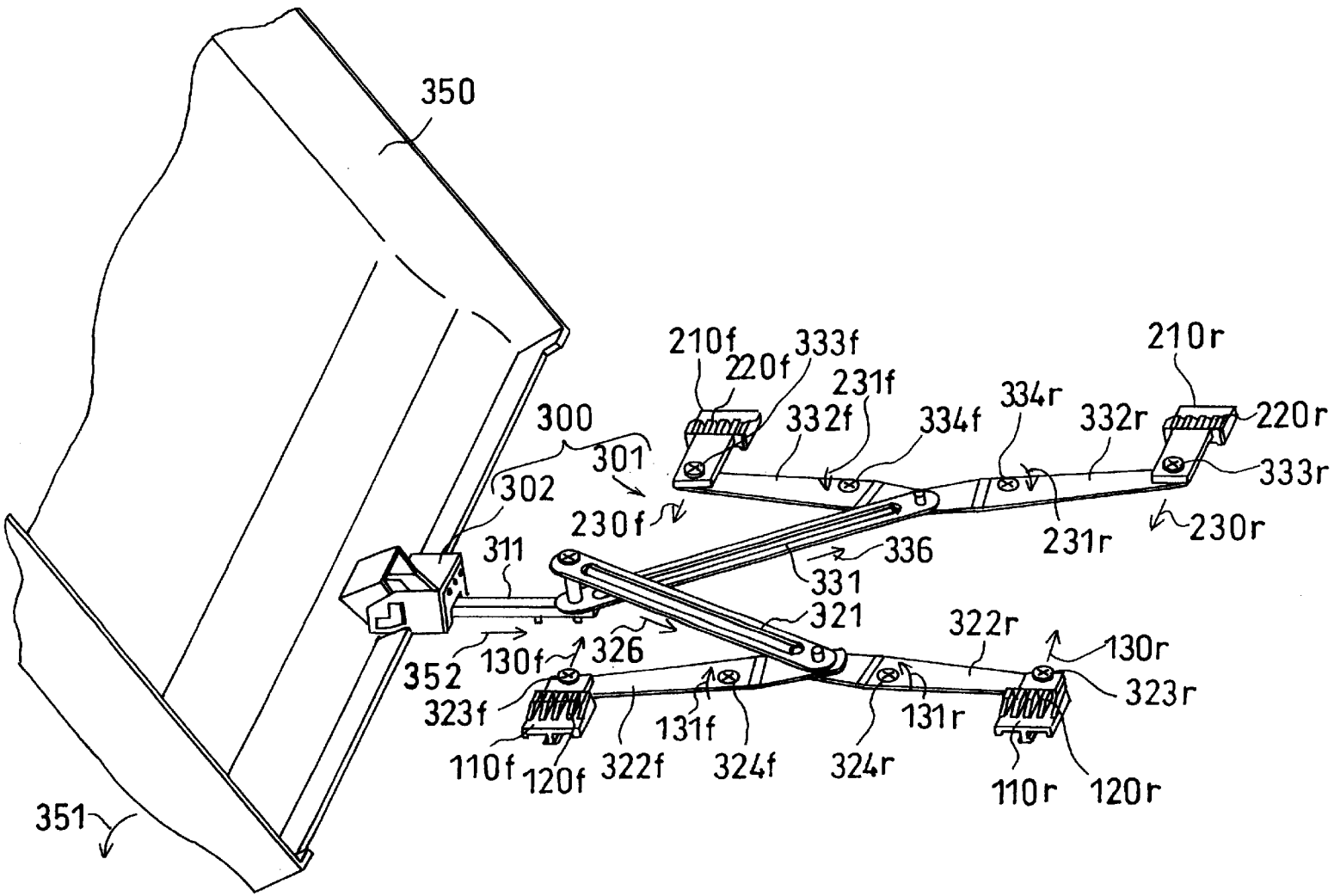
FIG. 6 is a perspective view for explaining the operation of the link mechanism when a front door is opened.

The following description will explain the operation when the respective doors 350, 150, and 250 are opened/closed from the foregoing condition. First, when the front door 350 is opened in a direction shown by an arrow 351 as shown in FIG. 6, an angular displacement in the direction shown by the arrow 351 is converted to a linear displacement from front to rear shown by an arrow 352, by the conversion mechanism 302. With this structure, the angular displacement in the direction shown by the arrow 351 in the front door 350 is given to the input lever 311 of the link 301. In the conversion mechanism 302, a connecting section between the front door 350 and the input lever 311 is located in vicinity to a rotation axis center of the front door 350, and it is structured to greatly displace the input lever 311 with a small angular displacement.

This displacement is given to the respective links 321 and 331 extending in the right and the left angularly sideward directions, and transmitted to the right and the left sides. Thus, outward displacements of the links 321 and 331 shown by arrows 326 and 336 are converted to inward displacements of the link blocks 110*f*, 110*r*; 210*f*, 210*r* shown by arrows 130*f*, 130*r*; 230*f*, 230*r*, by swing displacements of the links 322*f*, 322*r*; 332*f*, 332*r* shown by arrows 131*f*, 131*r*; 231*f*, 231*r*, respectively. The link blocks 110*f*, 110*r*; 210*f*, 210*r* have guiding slopes 120*f*, 120*r*; 220*f*, 220*r* sloping outwardly, respectively. Along these guiding slopes 120*f*, 120*r*; 220*f*, 220*r*, the support plates 109*f*, 109*r*; 209*f*, 209*r* of the holding stays 108 and 208 are guided, respectively. Meanwhile, the holding plates 101*f*, 101*r*; 201*f*, 201*r* are angularly displaced in directions shown by the arrows 140 and 240 in FIG. 5, respectively, and as shown from FIG. 3 to FIG. 2.

In association with this displacement, as shown in FIG. 2, the holding levers 105 and 205 and the holding arms 103 and 203 move together with the holding plates 101 and 201, as they are formed on the holding plates 101 and 201, respectively.

However, the respective ends on the other side of the holding levers 105 and 205 are displaced about the support axes 104 and 204 in the directions shown by the arrows 141 and 241, respectively, so as to come into contact with the driving members, and the holding arms 103 and 203 are also displaced in the directions shown by the arrows 142 and 242. Therefore, a height of the blocks 114 and 214 is further reduced, and the support axes 401 and 402 are lowered.

Figure 7:
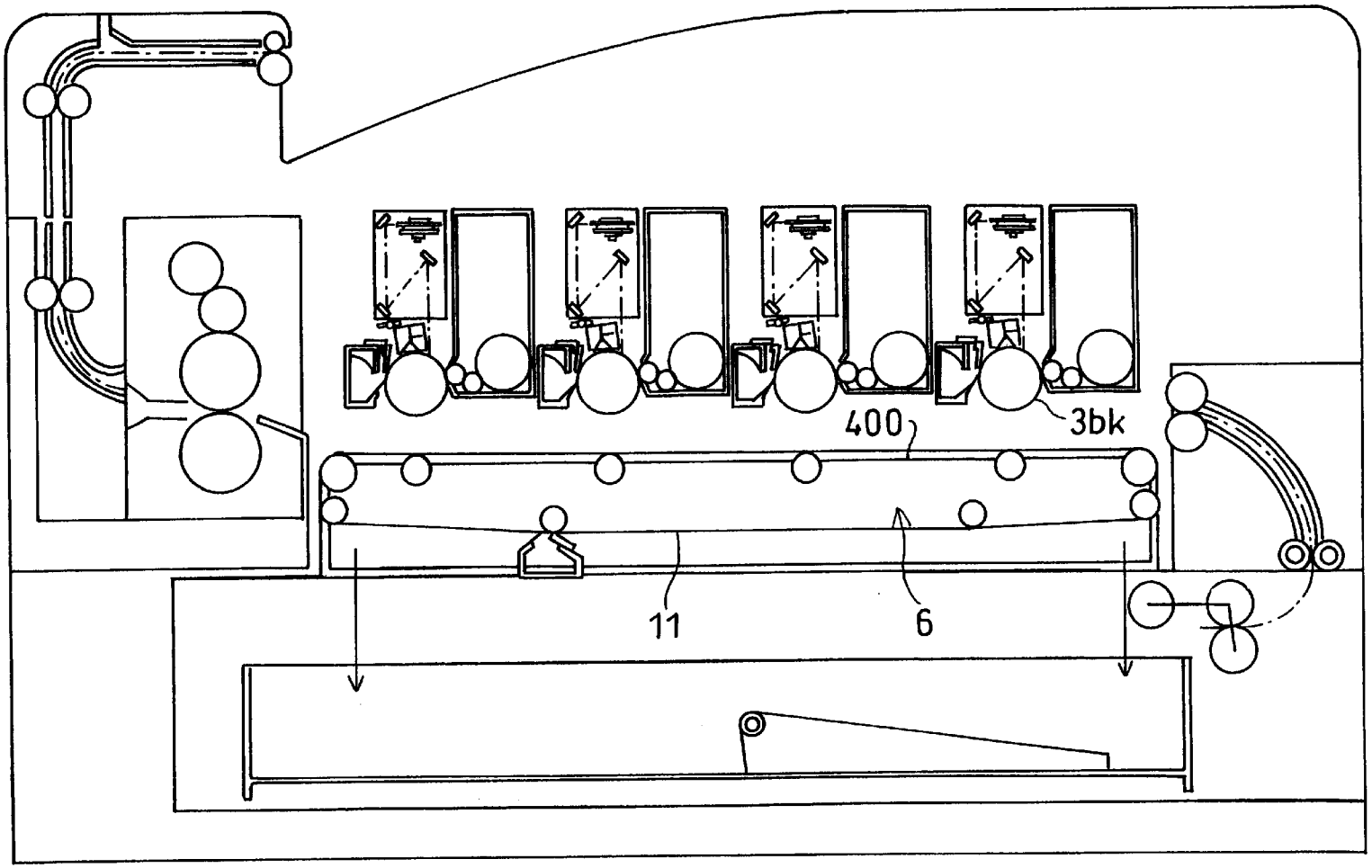
FIG. 7 is a view showing a state where a transfer frame is lowered by the opening of the front door.

That is, when the front door 350 is opened, the link mechanism 300 simultaneously operates the raising/lowering mechanisms 100 and 200 in association with the opening of the front door 350. In this manner, as shown in FIG. 7, the whole part of the transfer and transport belt unit 6 supported by the transfer frame 400 is lowered, and the transfer belt 11 is separated from the photoconductor drums 3. As a result, just by opening the front door 350, the handling of a paper jam from the front side can be easily carried out.

Figure 8:
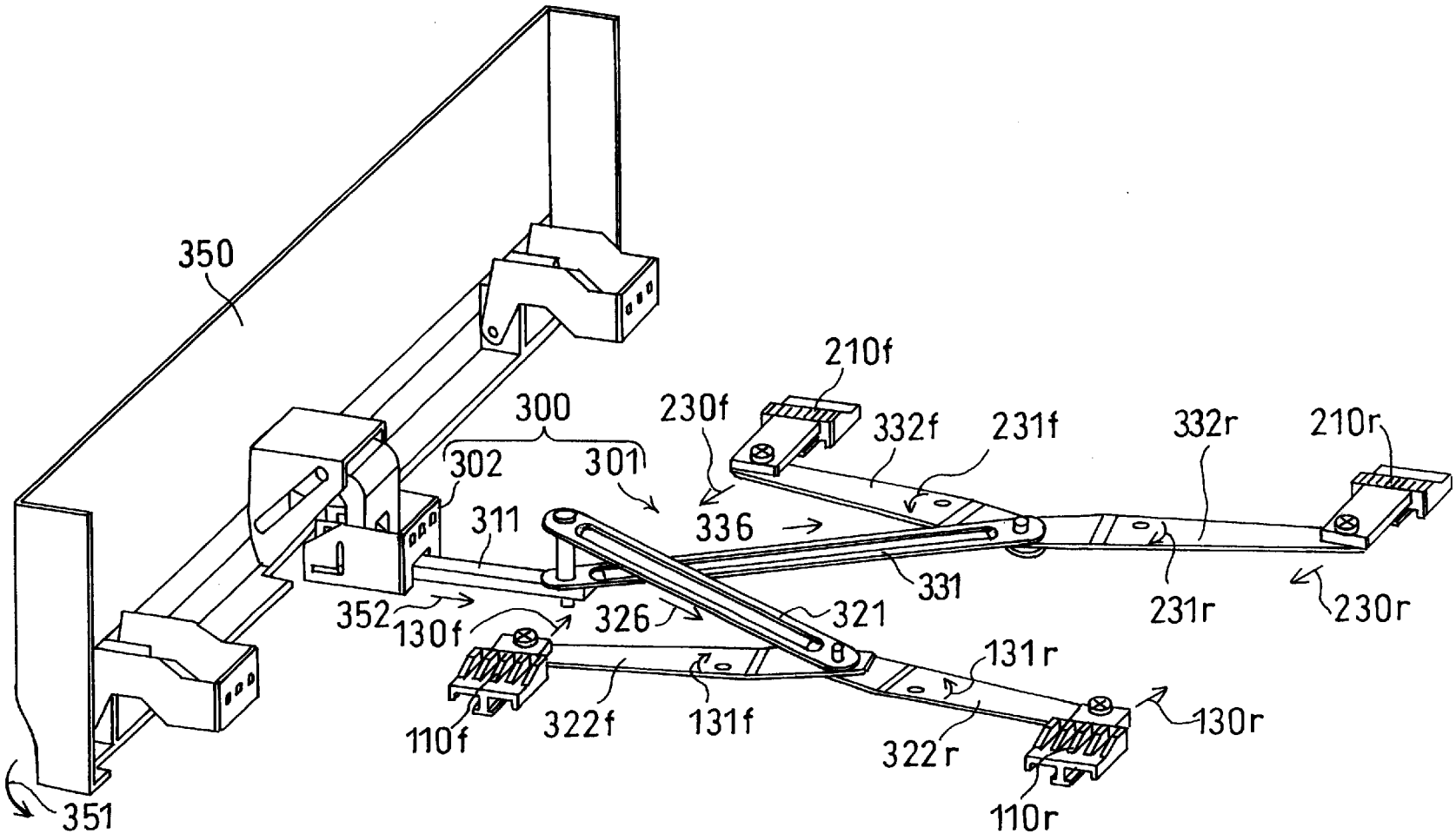
FIG. 8 is a perspective view for explaining the operation of the link mechanism when the front door is closed.

Next, FIG. 8 shows a condition in which the front door 350 is closed. When the front door 350 is angularly displaced in a direction opposite to the arrow 351 and closed, the input lever 311 is displaced from rear to front, in a direction opposite to the arrow 352, and the links 321 and 331 are displaced in directions opposite to the arrows 326 and 336, respectively. Thus, the links 322*f*, 322*r*; 332*f*, 332*r* are swingably displaced in directions opposite to the arrows 131*f*, 131*r*; 231*f*, 231*r*, and the link blocks 110*f*, 110*r*; 210*f*, 210*r* are displaced outwardly, in directions opposite to the arrows 130*f*, 130*r*; 230*f*, 230*r*, respectively.

Therefore, the support plates 109*f*, 109*r*; 209*f*, 209*r* of the holding stays 108 and 208 are guided along the guiding slopes 120*f*, 120*r*; 220*f*, 220*r* of the link blocks 110*f*, 110*r*; 210*f*, 210*r*, respectively. Besides, the holding plates 101*f*, 101*r*; 201*f*, 201*r* are angularly displaced in directions opposite to the arrows 140 and 240 in FIG. 5, respectively, and as shown from FIG. 2 to FIG. 3.

In association with this displacement, the respective ends on the other side of the holding levers 105 and 205 come into contact with the respective driving members, and the holding levers 105 and 205 are displaced in directions opposite to the arrows 141 and 241, and the holding arms 103 and 203 are displaced in directions opposite to the arrows 142 and 242, respectively. Besides, the blocks 114 and 214 push up the support axes 401 and 402, and the transfer and transport belt unit 6 comes into contact with the positioning member (not shown) and is positioned. Here, by the resilience of the compression springs 112 and 212, errors in raising amounts of the raising/lowering mechanisms 100 and 200 are absorbed, and the transfer belt 11 comes into contact with the photoconductor drums 3 at a constant pressure.

On the other hand, when the front door 350 and the right side door 150 are closed as mentioned above, the driving member 151 provided to the right side door 150 presses the other end of the holding lever 105, as shown in FIG. 9. With this structure, the support axes 401 are kept being pushed up by the block 114, via the holding arm 103.

Figure 10:
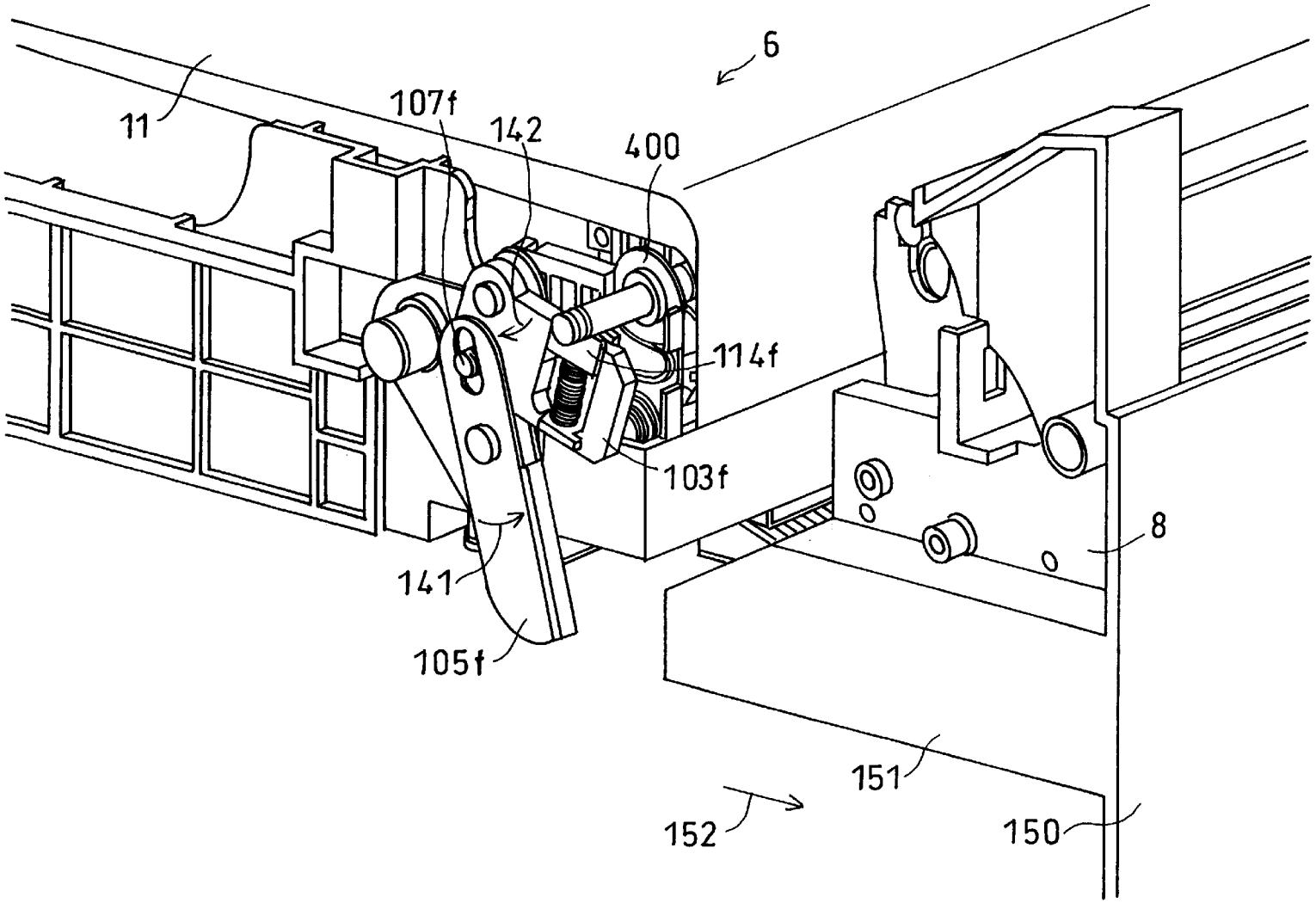
FIG. 10 is a perspective view for explaining the state where the right side door is opened and a paper transport unit is slid out, from the state shown in FIG. 9.

However, when the right side door 150 is opened in a direction shown by an arrow 152 and the paper transport unit 8 is slid out as shown in FIG. 10, the pressure by the driving member 151 is released. Consequently, the holding arm 103 is displaced in the direction shown by the arrow 142, by a weight of the part of the transfer and transport belt unit 6 supported by the transfer frame 400.

Figure 11:
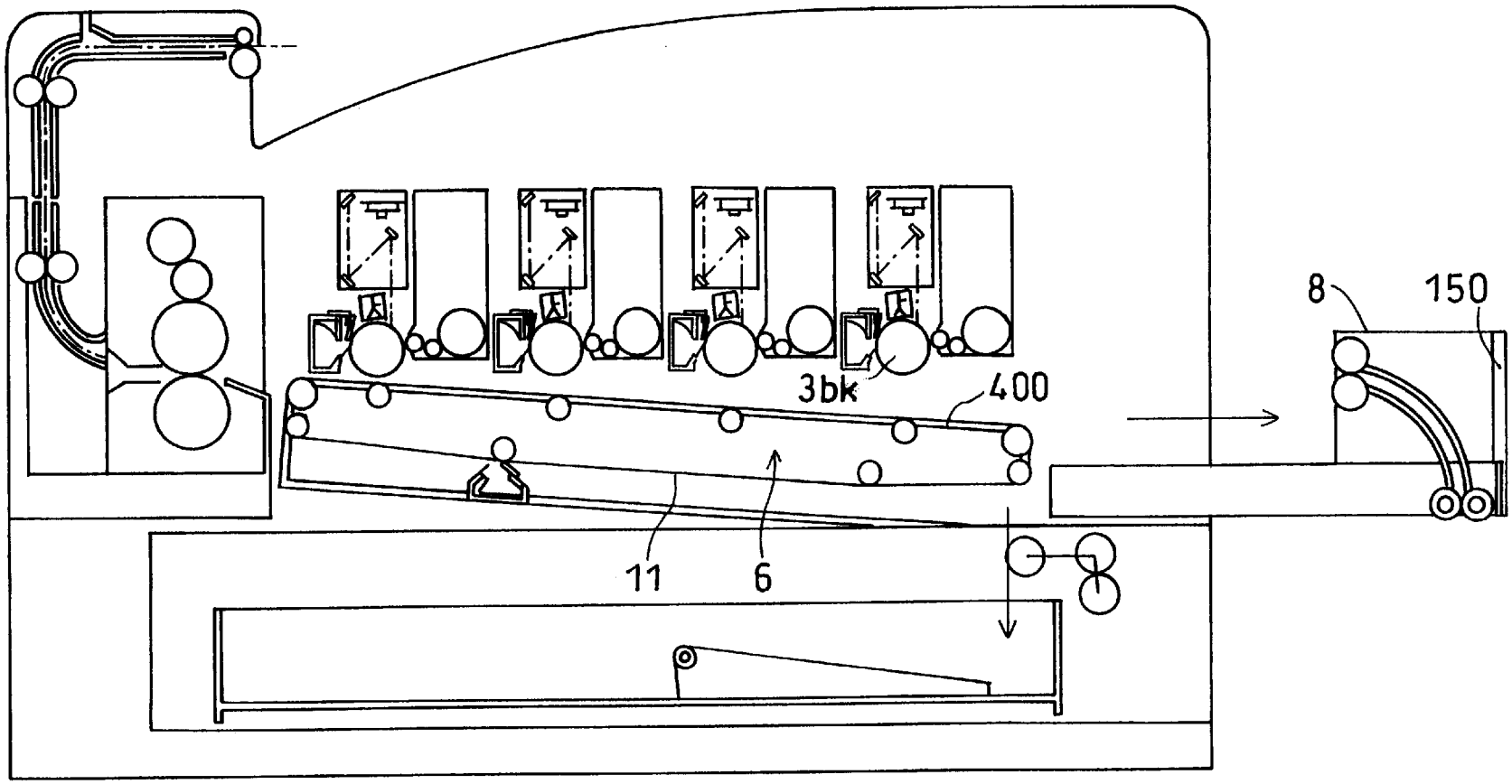
FIG. 11 is a view for explaining the state where the transfer frame is lowered in the state shown in FIG. 10.

Thus, the holding lever 105 is driven by the axis 107 and displaced in a direction opposite to the arrow 141. In this manner, as shown in FIG. 11, the right side part of the transfer and transport belt unit 6 is lowered, and the transfer belt 11 is separated from the photoconductor drums 3 (especially, from the photoconductor drum 3*bk* for black). As a result, just by opening the right side door 150, the handling of a paper jam from the right side can be easily carried out.

Figure 12:
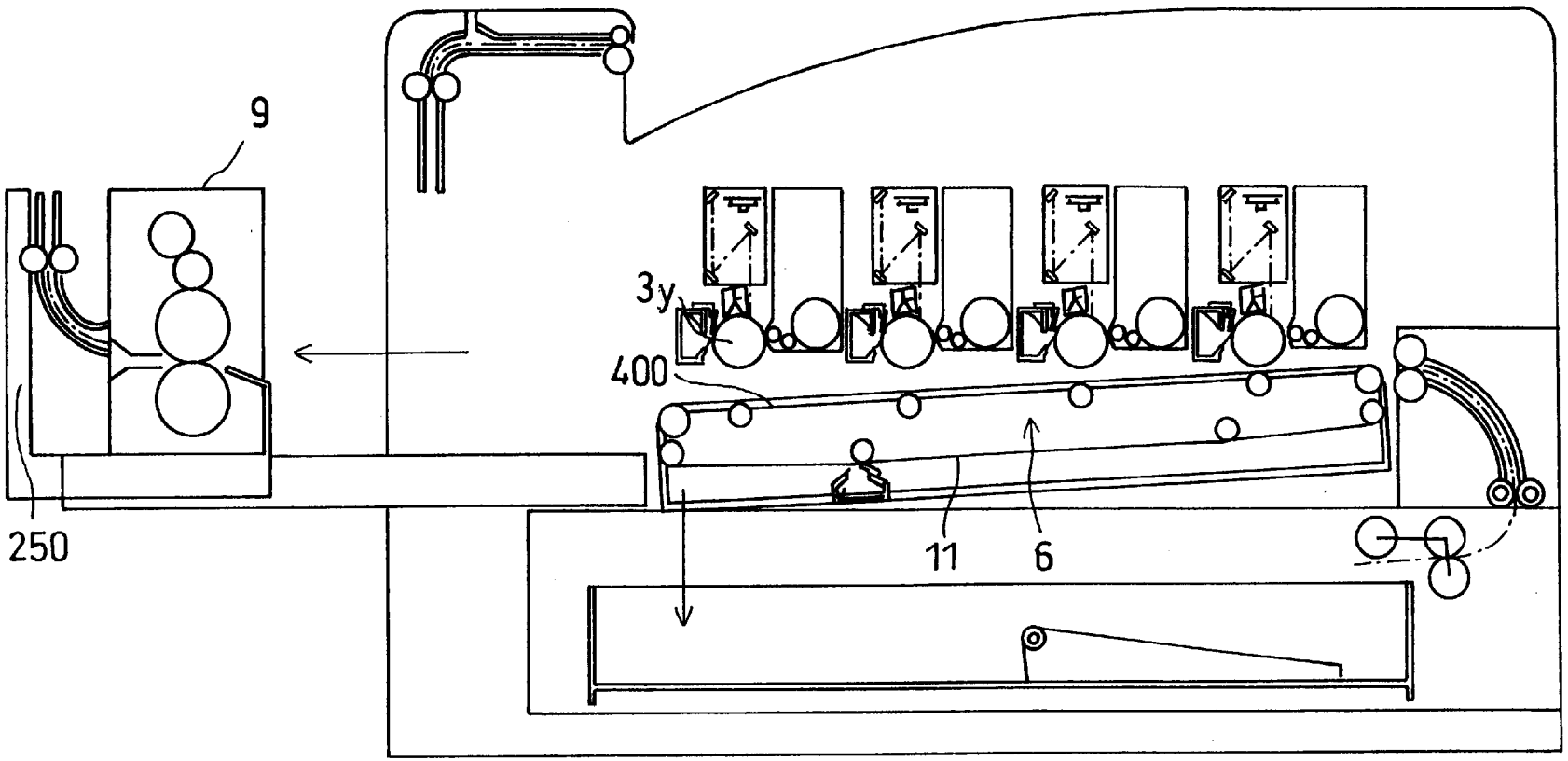
FIG. 12 is a view for explaining the state where the transfer frame is lowered when the front door is closed, a left side door is opened, and a fixing and paper discharge unit is slid out.

Similarly, as shown in FIG. 12, by opening the left side door 250 and sliding out the fixing and paper discharge unit 9, the left-side part of the transfer and transport belt unit 6 is lowered, and the transfer belt 11 is separated from the photoconductor drums 3 (especially, from the photoconductor drum 3*y* for yellow). Thus, just by opening the left side door 250, the handling of a paper jam from the left side can be easily carried out.

With such a structure, the transfer and transport belt unit 6 can be separated from the photoconductor drums 3 just by opening the doors 350, 150, and 250, in accordance with the opening of the doors 350, 150, and 250, from a plurality of access directions with respect to the image forming device. Therefore, to cope with various paper jams related to the transfer and transport belt unit 6, it becomes possible to handle a paper jam from the most appropriate direction. Besides, at the time of replacing the process unit, the replacement can be easily carried out by opening/closing a door which is appropriate for the replacement.

Furthermore, since separating/contacting operation is mechanically realized, this structure ensures the operation in association with the opening/closing of the doors 350, 150, and 250, and enables the separating/contacting operation to be carried out even when power supply is cut off. Or, by arranging to cut off power supply when a door is opened, that is, for example, to cut off power supply to at least high voltage systems such as the photoconductor drums 3, etc., this structure can enhance safety.

Incidentally, in the foregoing explanation, the support axes 401 and 402 are supported by the blocks 114 and 214, respectively, by being directly contacted and lifted. However, when a driving roller for supporting rollers or the axes themselves rotate, the support axes 401 and 402 may be satisfactorily supported via bearing members such as collars. That is, when the support axes 401 and 402 rotate together with the supporting following rollers 15 and 14, they may be supported by the blocks 114 and 214 via bearing members such as collars.

Besides, (2) Japanese Unexamined Patent Publication No. 6-9098 (Tokukaihei 6-9098, published on Jan. 18, 1994) discloses a method for mechanically releasing the pressure of a pressure roller to a resist roller by opening a paper discharge cover, which facilitates the handling of a paper jam. However, the technique in (2) is a simple structure such that a lever is kicked by a hook of the paper discharge cover and a support axis of the pressure roller is displaced by the lever. Therefore, the technique (2) cannot be applied to the transfer and transport belt unit 6 such as that in the present invention, which is tandem type, long from side to side.

Further, (3) Japanese Unexamined Patent Publication No. 11-349159 (Tokukaihei 11-349159, published on Dec. 21, 1999) also discloses a method for mechanically opening a paper passage passing across a plurality of paper trays which are vertically stacked, by opening a cover. However, the technique in (3) is just to free the rotation of a roller by opening the cover and releasing gear connection in a driving transmission system. Therefore, as in the case of the technique (2), the technique (3) cannot be applied to the transfer and transport belt unit 6 such as that in the present invention, which is tandem type, long from side to side.

As has been discussed, in an image forming device of the present invention, which is a tandem type, electrophotographic image forming device, a first separating/contacting mechanism mechanically lowers/raises the whole of a transfer frame holding a transfer and transport bearing element in association with the opening/closing of a front door of the main unit of the device; a second separating/contacting mechanism mechanically lowers/raises the right side of the transfer frame in association with the opening/closing of a right side door of the main unit of the device; a third separating/contacting mechanism mechanically lowers/raises the left side of the transfer frame in association with the opening/closing of a left side door of the main unit of the device; and just by opening a door from a plurality of access directions, the transfer and transport bearing element, which is formed to be long from side to side, is separated from an image bearing element in association with the opening of the door, on a side opened.

Consequently, to cope with various paper jams related to the transfer and transport bearing element, it becomes possible to handle a paper jam by opening/closing a door of the image forming device from the most appropriate direction. Besides, at the time of replacing a process unit, the replacement can be easily carried out by opening/closing a door which is appropriate for the replacement. Furthermore, since the opening/closing operation of the doors is mechanically converted to carry out separating/contacting operation of transfer and transport means (the transfer belt 11), this structure enables the separating/contacting operation to be carried out even when power supply is cut off. Or, by arranging to cut off power supply when a door is opened, this structure can enhance safety.

Besides, in the image forming device of the present invention, as described above, the transfer frame holding the transfer and transport bearing element has support axes protruding from its four corners in a front-to-rear direction, and the image forming device is structured so as to include:

holding plates each of which is swingably displaced about an axis line extending in the front-to-rear direction;

holding arms each of which raises/lowers each of the support axes by being swingably displaced about an axis provided on each of the holding plates;

holding levers each of which is swingably displaced about an axis provided on each of the holding plates, and has a long hole in which an axis provided on each of the holding arms is inserted with a clearance;

holding stays connecting lower parts of a pair of the holding plates provided in front and rear;

wedge-shaped link blocks located at the four corners of the transfer frame and inserted between the base of the main unit and the holding stays;

a link mechanism which extracts/inserts the link blocks in association with the opening/closing of the front door of the main unit of the device; and driving members each of which separates from or contacts an end section of each of the holding levers on a side opposite to a side provided with the long hole, in association with the opening/closing of the respective side doors of the main unit of the device, wherein the holding arms, the holding levers, the holding plates, the holding stays, the link blocks, and the link mechanism constitute the first separating/contacting mechanism, in which the link mechanism extracts/inserts the link blocks between the base of the main unit of the device and the holding stays in association with the opening/closing of the front door of the main unit of the device, lowering/raising the support axes at the four corners of the transfer frame together from the holding stays provided on the right and the left sides, via the holding plates, the holding levers, and the holding arms, and separating/contacting the transfer frame from/with the image bearing elements, and the holding arms, the holding levers, the holding plates, and the driving members constitute the second and the third separating/contacting mechanisms, in which the driving members provided to the respective side doors of the main unit of the device separate from or contact the end sections of the holding levers on the side opposite to the side provided with the long holes, in association with the opening/closing of the respective side doors, lowering/raising the support axes of the transfer frame on the sides of the respective side doors via the holding levers and the holding arms, and separating/contacting the respective sides of the transfer frame from/with the image bearing elements.

Therefore, the first through the third separating/contacting mechanisms can be specifically structured.

The image forming device of the present invention does not have to include all the first separating/contacting mechanism, the second separating/contacting mechanism, and the third separating/contacting mechanism, as the image forming device (a first image forming device) shown in FIGS. 1 through 12.

That is, the image forming device of the present invention may be an image forming device (a second image forming device) which includes at least one of the first separating/contacting mechanism, the second separating/contacting mechanism, and the third separating/contacting mechanism.

Also in the second image forming device, as in the first image forming device, the opening/closing operation of the doors is mechanically converted to carry out separating/contacting operation of the transfer and transport means, this structure enables the separating/contacting operation to be carried out even when power supply is cut off. Further, by arranging to cut off power supply when a door is opened, this structure can enhance safety when handling a paper jam.

Specific structures of the first separating/contacting mechanism, the second separating/contacting mechanism, and the third separating/contacting mechanism in the second image forming device may be identical to those of the foregoing link mechanism 300, the raising/lowering mechanism 100, and the raising/lowering mechanism 200, respectively. However, as for the support axes 401 and 402, they may be appropriately provided according to the link mechanism 300, the raising/lowering mechanism 100, and the raising/lowering mechanism 200.

That is, when the second image forming device has the link mechanism 300, it is structured to have both of the support axes 401 and 402 so as to lower/raise the whole of the transfer frame 400 in association with the opening/closing of the front door 350 of the main unit of the device.

On the other hand, when the second image forming device has the raising/lowering mechanism 100, it is satisfactory to lower/raise the right side of the transfer frame 400 in association with the opening/closing of the right side door 150 of the main unit of the device. Therefore, in this case, the second image forming device is structured to have at least the support axes 401 on the side close to the right side door 150 of the main unit of the device.

Besides, when the second image forming device has the raising/lowering mechanism 200, it is satisfactory to lower/raise the left side of the transfer frame 400 in association with the opening/closing of the left side door 250 of the main unit of the device. Therefore, in this case, the second image forming device is structured to have at least the support axes 402 on the side close to the left side door 250 of the main unit of the device.

The image forming device of the present invention, which is a tandem type, electrophotographic image forming device, may be an image forming device (a third image forming device) structured so as to include:

a transfer frame holding a transfer and transport bearing element;

a fixing unit fixing a toner image onto a sheet of paper;

a separating/contacting mechanism mechanically lowering/raising a side of the transfer frame close to the fixing unit in association with the sliding out/in of the fixing unit with respect to the device, and separating/contacting the side of the transfer frame from/with image bearing elements.

A specific structure of the separating/contacting mechanism provided in the third image forming device may be as follows, when explained based on the first image forming device shown in FIGS. 1 through 12.

The basic structure of the separating/contacting mechanism is identical to that of the raising/lowering mechanism 200 in the first image forming device. However, the transfer frame 400 does not have to have both of the support axes 401 and 402, and it may be structured to have at least the support axes 402 protruding from two corners on a side close to the fixing and paper discharge unit 9 in a front-to-rear direction. The fixing and paper discharge unit 9 is structured so as to have a driving member (not shown) corresponding to the driving member 151 provided to the right side door 150.

With this structure, the handling of a paper jam at a part from the transfer belt 11 to the vicinity of an entrance of the fixing and paper discharge unit 9, where paper jams often occur, can be carried out. Thus, operability when handling a paper jam can be substantially enhanced.

Incidentally, in the image forming device described in the foregoing (1) U.S. Pat. No. 4,873,541, the opening of the front door of the device is detected, and a side of the transfer and transport means (transfer belt) close to the door or the fixing unit is electrically tilted downward, which enables a jammed sheet of paper to be removed. That is, the image forming device described in (1) is structured such that the handling of a paper jam at a part from the transfer belt to the vicinity of an entrance of the fixing and paper discharge unit (fixing unit) can be carried out by opening the front door.

On the other hand, the foregoing third image forming device is structured so as to facilitate the handling of a paper jam at the part from the transfer belt 11 to the vicinity of the entrance of the fixing and paper discharge unit 9, by sliding out the fixing and paper discharge unit 9. With this structure, in the third image forming device, the handling of a paper jam at the part from the transfer belt 11 to the vicinity of the entrance of the fixing and paper discharge unit 9 can be carried out more securely than in the image forming device described in (1).

Also in the third image forming device, as in the first image forming device, the operation of sliding out/in the fixing and paper discharge unit 9 is mechanically converted to carry out separating/contacting operation of the transfer belt 11, this structure enables the separating/contacting operation to be carried out even when power supply is cut off. Further, by arranging to cut off power supply when the fixing and paper discharge unit 9 is slid out, that is, for example, to cut off power supply to at least high voltage systems such as the photoconductor drums 3, etc., this structure can enhance safety when handling a paper jam.

The image forming device of the present invention, which is a tandem type, electrophotographic image forming device, may be an image forming device (a fourth image forming device) structured so as to include:

a transfer frame holding a transfer and transport bearing element;

a transport unit transporting a sheet of paper to the transfer and transport bearing element; and a separating/contacting mechanism mechanically lowering/raising a side of the transfer frame close to the transport unit in association with the sliding out/in of the transport unit with respect to the device, and separating/contacting the side of the transfer frame from/with image bearing elements.

A specific structure of the separating/contacting mechanism provided in the fourth image forming device may be as follows, when explained based on the first image forming device shown in FIGS. 1 through 12.

The basic structure of the separating/contacting mechanism is identical to that of the raising/lowering mechanism 100 in the first image forming device. However, the transfer frame 400 does not have to have both of the support axes 401 and 402, and it may be structured to have at least the support axes 401 protruding from two corners on a side close to the paper transport unit 8 in a front-to-rear direction. The paper transport unit 8 is structured so as to have a driving member (not shown) corresponding to the driving member 151 provided to the right side door 150.

With this structure, the handling of a paper jam at a part from the vicinity of an exit of the paper transport unit 8 to the transfer belt 11, where paper jams often occur, can be carried out. Thus, operability when handling a paper jam can be substantially enhanced.

In other words, the fourth image forming device is structured so as to facilitate the handling of a paper jam at the part from the vicinity of the exit of the paper transport unit 8 to the transfer belt 11, by sliding out the paper transport unit 8. With this structure, in the fourth image forming device, the handling of a paper jam at the part from the vicinity of the exit of the paper transport unit 8 to the transfer belt 11 can be securely carried out.

Also in the fourth image forming device, as in the first image forming device, the operation of sliding out/in the paper transport unit 8 is mechanically converted to carry out separating/contacting operation of the transfer belt 11, this structure enables the separating/contacting operation to be carried out even when power supply is cut off. Further, by arranging to cut off power supply when the paper transport unit 8 is slid out, that is, for example, to cut off power supply to at least high voltage systems such as the photoconductor drums 3, etc., this structure can enhance safety when handling a paper jam.

The invention being thus described, it will be obvious that the same way be varied in many ways. Such variations are not to be regarded as a departure from the spirit and scope of the invention, and all such modifications as would be obvious to one skilled in the art are intended to be included within the scope of the following claims.

What is claimed is:

1. A tandem type, electrophotographic image forming device in which a plurality of image bearing elements bearing respective toner images are located in order from one side to another side of a main unit of the device, and a sheet of paper sequentially passes through the respective image bearing elements with being supported by a transfer and transport bearing element, so as to transfer a plurality of kinds of the toner images onto the sheet of paper, comprising:

a transfer frame holding the transfer and transport bearing element;

a fixing unit fixing the toner images onto the sheet of paper; and a separating/contacting mechanism mechanically lowering/raising a side of the transfer frame close to the fixing unit in association with sliding out/in of the fixing unit with respect to the device, and separating/contacting the side of the transfer frame from/with the image bearing elements, wherein:

the transfer frame has support axes protruding from two corners on a side close to the fixing unit in a front-to-rear direction, the image forming device further comprising:

holding plates each of which is swingably displaced about an axis line extending in the front-to-rear direction;

holding arms each of which raises/lowers each of the support axes by being swingably displaced about an axis provided on each of the holding plates;

holding levers each of which is swingably displaced about an axis provided on each of the holding plates, and has a long hole in which an axis provided on each of the holding arms is inserted with a clearance; and driving members each of which separates from or contacts an end section of each of the holding levers on a side opposite to a side provided with the long hole, in association with the sliding out/in of the fixing unit with respect to the device, wherein the holding arms, the holding levers, the holding plates, and the driving members constitute the separating/contacting mechanism, in which the driving members provided to the fixing unit separate from or contact the end sections of the holding levers on the side opposite to the side provided with the long holes, in association with the sliding out/in of the fixing unit with respect to the device, lowering/raising the support axes via the holding levers and the holding arms, and separating/contacting the side of the transfer frame close to the fixing unit from/with the image bearing elements.

2. A tandem type, electrophotographic image forming device in which a plurality of image bearing elements bearing respective toner images are located in order from one side to another side of a main unit of the device, and a sheet of paper sequentially passes through the respective image bearing elements with being supported by a transfer and transport bearing element, so as to transfer a plurality of kinds of the toner images onto the sheet of paper, comprising:

a transfer frame holding the transfer and transport bearing element;

a first separating/contacting mechanism mechanically lowering/raising a whole of the transfer frame in association with opening/closing of a front door of the main unit of the device, and separating/contacting the transfer frame from/with the image bearing elements;

a second separating/contacting mechanism mechanically lowering/raising a right side of the transfer frame in association with opening/closing of a right side door of the main unit of the device, and separating/contacting the right side of the transfer frame from/with the image bearing elements; and a third separating/contacting mechanism mechanically lowering/raising a left side of the transfer frame in association with opening/closing of a left side door of the main unit of the device, and separating/contacting the left side of the transfer frame from/with the image bearing elements.

3. The image forming device of claim 2, wherein:

the transfer frame holding the transfer and transport bearing element has support axes protruding from four corners in a front-to-rear direction, the image forming device further comprising:

holding plates each of which is swingably displaced about an axis line extending in the front-to-rear direction;

holding arms each of which raises/lowers each of the support axes by being swingably displaced about an axis provided on each of the holding plates;

holding levers each of which is swingably displaced about an axis provided on each of the holding plates, and has a long hole in which an axis provided on each of the holding arms is inserted with a clearance;

holding stays connecting lower parts of a pair of the holding plates provided in front and rear;

wedge-shaped link blocks located at the four corners of the transfer frame and inserted between a base of the main unit and the holding stays;

a link mechanism which extracts/inserts the link blocks in association with the opening/closing of the front door of the main unit of the device; and driving members each of which separates from or contacts an end section of each of the holding levers on a side opposite to a side provided with the long hole, in association with the opening/closing of the respective side doors of the main unit of the device, wherein the holding arms, the holding levers, the holding plates, the holding stays, the link blocks, and the link mechanism constitute the first separating/contacting mechanism, in which the link mechanism extracts/inserts the link blocks between the base of the main unit of the device and the holding stays in association with the opening/closing of the front door of the main unit of the device, lowering/raising the support axes at the four corners of the transfer frame together from the holding stays provided on right and left sides, via the holding plates, the holding levers, and the holding arms, and separating/contacting the transfer frame from/with the image bearing elements, and the holding arms, the holding levers, the holding plates, and the driving members constitute the second and the third separating/contacting mechanisms, in which the driving members provided to the respective side doors of the main unit of the device separate from or contact the end sections of the holding levers on the side opposite to the side provided with the long holes, in association with the opening/closing of the respective side doors, lowering/raising the support axes of the transfer frame on sides of the respective side doors via the holding levers and the holding arms, and separating/contacting the respective sides of the transfer frame from/with the image bearing elements.

4. A tandem type, electrophotographic image brining device in which a plurality of image bearing elements bearing respective toner images are located in order from one side to another side of a main unit of the device, and a sheet of paper sequentially passes through the respective image bearing elements with being supported by a transfer and transport bearing element, so as to transfer a plurality of kinds of the toner images onto the sheet of paper, comprising:

a transfer frame holding the transfer and transport bearing element; and a first separating/contacting mechanism mechanically lowering/raising a whole of the transfer frame in association with opening/closing of a front door of the main unit of the device, and separating/contacting the transfer frame from/with the image bearing elements, wherein:

the transfer frame has support axes protruding from four corners in a front-to-rear direction, the image forming device further comprising:

holding plates each of which is swingably displaced about an axis line extending in the front-to-rear direction;

holding arms each of which raises/lowers each of the support axes by being swingably displaced about an axis provided on each of the holding plates;

holding levers each of which is swingably displaced about an axis provided on each of the holding plates, and has a long hole in which an axis provided on each of the holding arms is inserted with a clearance;

holding stays connecting lower parts of a pair of the holding plates provided in front and rear;

wedge-shaped link blocks located at the four corners of the transfer frame and inserted between a base of the main unit and the holding stays; and a link mechanism which extracts/inserts the link blocks in association with the opening/closing of the front door of the main unit of the device, wherein the holding arms, the holding levers, the holding plates, the holding stays, the link blocks, and the link mechanism constitute the first separating/contacting mechanism, in which the link mechanism extracts/inserts the link blocks between the base of the main unit of the device and the holding stays in association with the opening/closing of the front door of the main unit of the device, lowering/raising the support axes at the four corners of the transfer frame together from the holding stays provided on right and left sides, via the holding plates, the holding levers, and the holding arms, and separating/contacting the transfer frame from/with the image bearing elements.

5. A tandem type, electrophotographic image forming device in which a plurality of image bearing elements bearing respective toner images are located in order from one side to another side of a main unit of the device, and a sheet of paper sequentially passes through the respective image bearing elements with being supported by a transfer and transport bearing element, so as to transfer a plurality of kinds of the toner images onto the sheet of paper, comprising:

a transfer frame holding the transfer and transport bearing element; and a separating/contacting mechanism mechanically lowering/raising a right side of the transfer frame in association with opening/closing of a right side door of the main unit of the device, and separating/contacting the right side of the transfer frame from/with the image bearing elements, wherein:

the transfer frame has support axes protruding in a front-to-rear direction from two corners on a side close to the right side door of the main unit of the device, the image forming device further comprising:

holding plates each of which is swingably displaced about an axis line extending in the front-to-rear direction;

holding arms each of which raises/lowers each of the support axes by being swingably displaced about an axis provided on each of the holding plates;

holding levers each of which is swingably displaced about an axis provided on each of the holding plates, and has a long hole in which an axis provided on each of the holding arms is inserted with a clearance; and driving members each of which separates from or contacts an end section of each of the holding levers on a side opposite to a side provided with the long hole, in association with the opening/closing of the right side door of the main unit of the device, wherein the holding arms, the holding levers, the holding plates, and the driving members constitute the second separating/contacting mechanism, in which the driving members provided to the right side door of the main unit of the device separate from or contact the end sections of the holding levers on the side opposite to the side provided with the long holes, in association with the opening/closing of the right side door, lowering/raising the support axes via the holding levers and the holding arms, and separating/contacting the right side of the transfer frame from/with the image bearing elements.

6. A tandem type, electrophotographic image forming device in which a plurality of image bearing elements bearing respective toner images are located in order from one side to another side of a main unit of the device, and a sheet of paper sequentially passes through the respective image bearing elements with being supported by a transfer and transport bearing element, so as to transfer a plurality of kinds of the toner images onto the sheet of paper, comprising:

a transfer frame holding the transfer and transport bearing element; and a separating/contacting mechanism mechanically lowering/raising a left side of the transfer frame in association with opening/closing of a left side door of the main unit of the device, and separating/contacting the left side of the transfer frame from/with the image bearing elements, wherein:

the transfer frame has support axes protruding in a front-to-rear direction from two corners on a side close to the left side door of the main unit of the device, the image forming device further comprising:

holding plates each of which is swingably displaced about an axis line extending in the front-to-rear direction;

holding arms each of which raises/lowers each of the support axes by being swingably displaced about an axis provided on each of the holding plates;

holding levers each of which is swingably displaced about an axis provided on each of the holding plates, and has a long hole in which an axis provided on each of the holding arms is inserted with a clearance; and driving members each of which separates from or contacts an end section of each of the holding levers on a side opposite to a side provided with the long hole, in association with the opening/closing of the left side door of the main unit of the device, wherein the holding arms, the holding levers, the holding plates, and the driving members constitute the third separating/contacting mechanism, in which the driving members provided to the left side door of the main unit of the device separate from or contact the end sections of the holding levers on the side opposite to the side provided with the long holes, in association with the opening/closing of the left side door, lowering/raising the support axes via the holding levers and the holding arms, and separating/contacting the left side of the transfer frame from/with the image bearing elements.

7. A tandem type, electrophotographic image forming device in which a plurality of image bearing elements bearing respective toner images are located in order from one side to another side of a main unit of the device, and a sheet of paper sequentially passes through the respective image bearing elements with being supported by a transfer and transport bearing element, so as to transfer a plurality of kinds of the toner images onto the sheet of paper, comprising:

a transfer frame holding the transfer and transport bearing element;

a transport unit transporting the sheet of paper onto the transfer and transport bearing element; and a separating/contacting mechanism mechanically lowering/raising a side of the transfer frame close to the transport unit in association with sliding out/in of the transport unit with respect to the device, and separating/contacting the side of the transfer frame from/with the image bearing elements, wherein:

the transfer frame holding the transfer and transport bearing element has support axes protruding from two corners on a side close to the transport unit in a front-to-rear direction, the image forming device further comprising:

holding plates each of which is swingably displaced about an axis line extending in the front-to-rear direction;

holding arms each of which raises/lowers each of the support axes by being swingably displaced about an axis provided on each of the holding plates;

holding levers each of which is swingably displaced about an axis provided on each of the holding plates, and has a long hole in which an axis provided on each of the holding arms is inserted with a clearance; and driving members each of which separates from or contacts an end section of each of the holding levers on a side opposite to a side provided with the long hole, in association with the sliding out/in of the transport unit with respect to the device, wherein the holding arms, the holding levers, the holding plates, and the driving members constitute the separating/contacting mechanism, in which the driving members provided to the transport unit separate from or contact the end sections of the holding levers on the side opposite to the side provided with the long holes, in association with the sliding out/in of the transport unit with respect to the device, lowering/raising the support axes via the holding levers and the holding arms, and separating/contacting the side of the transfer frame close to the transport unit from/with the image bearing elements.

* * * * *

UNITED STATES PATENT AND TRADEMARK OFFICE

CERTIFICATE OF CORRECTION

PATENT NO. : 6,647,228 B2
DATED : November 11, 2003
INVENTOR(S) : Nakamura et al.

It is certified that error appears in the above-identified patent and that said Letters Patent is hereby corrected as shown below:

Title page,
Item [56], References Cited, FOREIGN PATENT DOCUMENTS, please list
-- JP 11-161067 June 1999 --.

Signed and Sealed this

Eighteenth Day of May, 2004

JON W. DUDAS
*Acting Director of the United States Patent and Trademark Office*